US006371125B1

(12) United States Patent
Schmidt

(10) Patent No.: US 6,371,125 B1
(45) Date of Patent: Apr. 16, 2002

(54) APPARATUS FOR TRANSFERRING FILTER RODS CONTAINING PULVERULENT, GRANULAR AND ANALOGOUS INGREDIENTS

(75) Inventor: Hans-Herbert Schmidt, Hamburg (DE)

(73) Assignee: Hauni Maschinenbau AG (DE)

( * ) Notice: Subject to any disclaimer, the term of this patent is extended or adjusted under 35 U.S.C. 154(b) by 0 days.

(21) Appl. No.: 09/536,322

(22) Filed: Mar. 27, 2000

(30) Foreign Application Priority Data

Mar. 25, 1999 (DE) ..... 199 13 422

(51) Int. Cl.[7] ..... A24B 1/02

(52) U.S. Cl. ..... 131/109.2; 131/110; 406/107; 406/68; 406/148; 406/191

(58) Field of Search ..... 406/65, 67, 68, 406/107, 147, 148, 191, 109.2, 110; 131/282

(56) References Cited

U.S. PATENT DOCUMENTS

| | | | | |
|---|---|---|---|---|
| 2,682,085 A | * | 6/1954 | Novotny et al. | 19/76 |
| 3,826,065 A | * | 7/1974 | Labbe | 55/309 |
| 4,055,192 A | * | 10/1977 | Berlin et al. | 131/84 B |
| 5,536,118 A | * | 7/1996 | Schmidt et al. | 406/68 |
| 5,556,236 A | | 9/1996 | Seim, II et al. | |
| 5,651,643 A | | 7/1997 | Haul et al. | |
| 6,210,080 B1 | * | 4/2001 | Haul et al. | 406/13 |

FOREIGN PATENT DOCUMENTS

| | | |
|---|---|---|
| EP | 0 699 396 | 3/1996 |
| GB | 1 410 473 | 10/1975 |

* cited by examiner

*Primary Examiner*—Joseph E. Valenza
*Assistant Examiner*—Joe Dillon, Jr.
(74) *Attorney, Agent, or Firm*—Venable; George H. Spencer; Robert Kinberg

(57) ABSTRACT

Apparatus for transporting rod-shaped tobacco smoke filters which contain and/or carry particles of charcoal and/or other solid particulate tobacco smoke filtering and/or flavoring material. A sender directs a series of successive filters lengthwise into a pneumatic conduit wherein the filters advance toward a receiving station. A section of the conduit has an arcuate shape and advances successive filters from a lower level to a higher level. The underside of the section has an elongated arcuate opening which is overlapped by a cover in such a way that any solid particles which became separated from the filters can be expelled into a neighboring chamber due to fluid pressure in the section as well as under the action of gravity and/or centrifugal force. Such particles are evacuated by way of an outlet at the lower end of the chamber, either by manually operated valves which control the admission of particles from the chamber into a compartment and from the compartment, or by automatically operated valves which open at close at predetermined intervals.

20 Claims, 3 Drawing Sheets

APPARATUS FOR TRANSFERRING FILTER RODS CONTAINING PULVERULENT, GRANULAR AND ANALOGOUS INGREDIENTS

CROSS-REFERENCE TO RELATED CASES

This application claims the priority of German patent application Serial No. 199 13 427.7 filed Mar. 25, 1999. The disclosure of the above-referenced German patent application, as well as that of each U.S. and foreign patent and patent application mentioned in the specification of the present application, is incorporated herein by reference.

BACKGROUND OF THE INVENTION

The invention relates to improvements in apparatus for manipulating sections of rod-like filters for tobacco smoke, and more particularly to improvements in apparatus for transferring sections of rod-like filters which contain pulverulent, granular and analogous solid ingredients, such as charcoal.

It is often necessary to transport rod-like filters for tobacco smoke (hereinafter called filters for short) between two spaced-apart locations, particularly between a sender (such as a filter rod maker) which is set up to deliver successive filters of a short or long series of filters lengthwise into a pneumatic conveyor for transport to a receiving station, e.g., to the magazine of a filter tipping machine. Such apparatus are often equipped with arrangements which are designed to intercept, collect and dispose of solid particles which become separated from the rod-like filler (such as a filler consisting of crepe or acetate fibers). In the absence of any undertakings to the contrary, stray particles of charcoal or the like which become separated from filters in the pneumatic conveyor are likely or bound to contaminate the conveyor and/or the receiving station to an extent which necessitates temporary stoppages of the apparatus in order to carry out a cleaning operation or to permit a restarting of the apparatus.

Moreover, loose particles of charcoal or the like tend to adhere to the external surfaces and to thus contaminate the tubular wrappers of the filters.

Attempts to gather stray particles of charcoal or the like in apparatus which are designed to transport rod-like filters for tobacco smoke are disclosed, for example, in commonly owned British patent specification No. 1 410 473 (published Oct. 15, 1975) and in the U.S. Pat. No. 5,556,236 granted Sep. 17, 1996. The aforementioned patents share the feature that an arcuate section of the pneumatic conveyor is provided with an opening for the evacuation of solid particles which escape from the rod-like fillers of the filters and/or become separated from the external surfaces of the tubular envelopes for the fillers. The solid particles can be selected to enhance the tobacco smoke filtering action and/or to enhance the flavor of tobacco smoke furnished by a lighted filter cigarette, cigar or cigarillo.

Certain presently known filter lines which are capable of introducing particles of charcoal or the like into the fillers of acetate fibers or the like are known as AC 2 and AC 3 (both distributed by the assignee of the present application). The operation of each of these AC machines is based on the principle that charcoal is fed into a collector where it stays until a demand signal from a reservoir initiates a feed operation. Each AC machine cooperates with a filter rod making machine (e.g., a machine known as KDF and distributed by the assignee of the present application), and each filter rod making machine can be equipped with means for aspirating stray granules off the so-called garniture of the filter rod making machine by resorting to a so-called extraction hood which returns the aspirated granules to the source by way of a pipeline or the like.

OBJECTS OF THE INVENTION

An object of the present invention is to provide an apparatus which can transport rod-like filters for tobacco smoke in such a way that all or nearly all loose solid particles (such as charcoal granules) advancing with the filters from a sender to a receiving station can be intercepted, collected and disposed of (e.g., reused) with a higher degree of reliability than in heretofore known apparatus.

Another object of the invention is to provide a novel and improved pneumatic conveyor for use in the above outlined apparatus.

A further object of the invention is to provide an apparatus which prevents pronounced and/or long-lasting frictional engagement between the external surfaces of tubular wrappers of rod-like filters for tobacco smoke and stray particles of charcoal and the like.

An additional object of the invention is to provide a novel and improved module which can be utilized to convert a conventional filter manipulating apparatus into a superior apparatus capable of intercepting and gathering much higher percentages of loose solid particles of charcoal and the like.

Still another object of the invention is to provide a novel and improved method of intercepting, gathering and evacuating loose particles of charcoal or the like from apparatus for transporting and/or otherwise manipulating rod-like filters for tobacco smoke.

A further object of the invention is to provide a rod-like filter for tobacco smoke which is produced in the above outlined novel apparatus and/or in accordance with the above-outlined method.

SUMMARY OF THE INVENTION

One feature of the present invention resides in the provision of an apparatus for transporting tobacco smoke filtering rods, which carry solid particles (such as charcoal granules), along an elongated path extending from a sender (such as a filter rod maker) to a receiving station (e.g., into the magazine of a filter tipping machine).

The improved apparatus comprises a pneumatic conveyor defining an elongated path for lengthwise advancement of successive filtering rods of a file of filtering rods by means of a pressurized pneumatic fluid (such as compressed air) in a direction from the sender to the receiving station. The conveyor comprises a section which is located downstream of the sender, which extends along an arc of less than 180° (for example, along an arc which equals or approximates 90°), and which is arranged to advance successive filtering rods from a lower level to a higher level. The conveyor section has an at least substantially sealed arcuate upper side and an at least partially open arcuate underside, and the improved apparatus further comprises a cover which overlies the underside of the conveyor section and is arranged to permit expulsion of loose solid particles from the elongated path into a chamber of a collecting device but to interfere with appreciable flow of pressurized gaseous fluid from the conveyor section into the chamber of the collecting device.

The conveyor section is or can be adjacent (e.g., closely or very closely adjacent) the sender.

The internal surface of the conveyor (such as an elongated conduit) has an internal surface which can include a convex portion at the upper side and a concave portion at the underside of the conveyor section.

The cover is or can be elongated and can include a first end portion and a second end portion at a level above the first end portion; one of these end portions (preferably the upper end portion) is or can be provided with a lug, flap or an analogous deflector for gaseous fluid.

The cover can have a concavo-convex shape, and its concave side can confront the underside of the conveyor section. For example, the cover can be made (at least in part) of metallic sheet material and can be precurved at the locus of manufacture.

An upper end portion of the aforementioned collecting device can be installed downstream of the lower end portion (as seen in the direction of advancement of filtering rods from the sender to the receiving station), and the lower end portion can be provided with at least one outlet for collected solid particles.

The at least one outlet can define at least one compartment having a particle receiving portion and a particle discharging portion. A first open-and-shut valve can be employed and actuated to connect the receiving portion of the compartment with the chamber of the collecting device, and a second open-and-shut valve can be provided and actuated to permit and interrupt evacuation of solid particles from the discharging portion of the compartment. Alternatively, the at least one outlet can include automatically operable valve means serving to establish and to interrupt communication between the chamber of the collecting device and the at least one compartment of the outlet. For example, the automatically operable valve means can include means for permitting and interrupting evacuation of solid particles from the at least one compartment. Such valve means can be arranged to regulate the admission of solid particles into and the evacuation of solid particles from the at least one compartment as a function of time.

The aforementioned conveyor section can form part of a prefabricated module, preferably a mobile module. The conveyor section which forms part of such mobile module can be detached from and separably connected to additional sections of the conveyor.

The receiving station can include a magazine or other suitable means for temporarily storing at least one supply of filtering rods.

The sender can include means for pneumatically propelling filtering rods into an inlet of the pneumatic conveyor upstream of the aforementioned conveyor section (as seen in the direction of advancement of filtering rods toward the receiving station). Furthermore, the sender can include means for advancing filtering rods in several directions, for example, first (e.g., downwardly) along an at least substantially vertical path and thereupon along a substantially horizontal path.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of numerous presently preferred specific embodiments with reference to the accompanying drawings.

DESCRIPTION OF PREFERRED EMBODIMENTS

Figure 1:
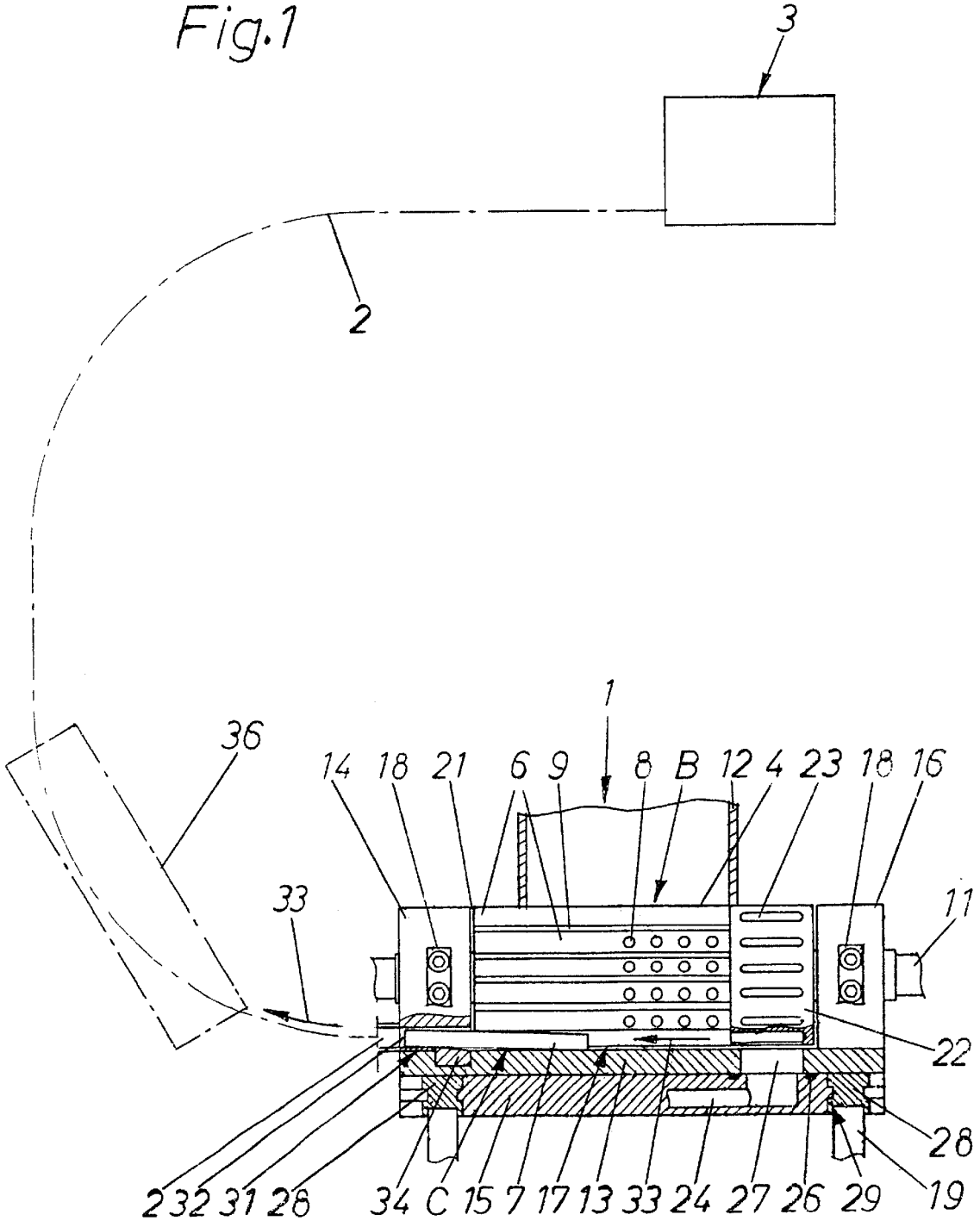
FIG. 1 is a partly schematic elevational view of an apparatus which embodies one form of the invention, portions of the sender being shown in a vertical sectional view.

FIG. 1 shows an apparatus which is constructed and assembled to transport filter rod sections (hereinafter filters) 7 of unit or multiple unit length, e.g., double unit or quadruple unit length. The apparatus comprises a sender 1, a receiving station 3 (e.g., a station accommodating a machine known as FILTROMAT which is distributed by the assignee of the present application), and a pneumatic conveyor 2 which defines an elongated path extending from the sender 1 to the receiving station 3 and serving to guide successive filters 7 lengthwise in the direction indicated by the arrows 33. FILTROMAT is a machine which is designed to supply or convey filters to consuming or processing machines, e.g., to filter tipping machines wherein tobacco smoke filters of selected lengths are united with plain cigarettes, cigars or cigarillos to form therewith filter cigarettes, cigars or cigarillos of desired length.

The sender 1 comprises a horizontal rotary drum-shaped conveyor 4 (hereinafter drum) having axially parallel peripheral flutes 6 separated from each other by elongated ridges or ribs 9 and communicating with suction ports 8 in certain angular positions to attract and transport discrete filters 7 sideways from a source 12 toward positions of alignment with the inlet of the pneumatic conveyor 2 (hereinafter conduit for short).

The drum 4 can receive torque from a horizontal shaft 11 which is rotatable relative to two spaced-apart sleeve-like bearing members 14, 16 and is driven by a suitable prime mover (e.g., an electric motor), not shown. Successive ridges 9 of the drum 4 can cooperate with a mobile sealing member 13 to ensure predictable optimum axial propulsion of successive filters 7 arriving to positions for abrupt advancement into the inlet of the conduit 2.

The illustrated source 12 is an upright chute or duct which receives filters from one or more makers and admits successive filters sideways into oncoming flutes 6 at a location B. The location of axial transfer of filters 7 is from their flutes 6 into the inlet of the conduit 2 is shown at C. The conduit 2 of FIGS. 1 to 4 includes a first stationary section which is connected with the sender 1 in the region of the bearing member 14, a second stationary section having a discharge end located at the receiving station 3, and a mobile intermediate section 36 between the two stationary sections and rather closely adjacent the sender 1. As indicated by the left-hand arrow 33 of FIG. 1, the mounting and the operation of the conduit 2 are such that successive filters 7 arriving from the source 12 are propelled upwardly, at least in the section 36.

The aforementioned sealing member 13 is movable between the illustrated raised (sealing) position, which it assumes during propulsion of a filter 7 from its flute 6 into the conduit 2, and a lowered or retracted position in which the parts 4, 13 define an arcuate clearance 17. The upper side of the sealing member 13 constitutes a concave surface having a radius of curvature complementary to that of the periphery of the drum 4. The concave surface of the sealing member 13 can abut the adjacent convex surfaces of the bearing members 14, 16 in such a way that the elongated surfaces (top lands) at the radially outermost portions of the ridges 9 occupying the location C do not actually contact the sealing member 13.

The drive shaft 11 for the drum 4 extends axially beyond at least one of the bearing members 14, 16 and is journalled, without radial play, in stationary walls (not shown).

The reference characters 18 denote tensioning crossheads which fixedly connect the bearing members 14, 16 with a preferably plate-like support, not shown. Such support further serves to guide a carrier 15 for the sealing member 13 as well as to mount two compressed-air pistons 19 which are utilized to move the sealing member 13 and its carrier 15 up and down between their operative and retracted positions. The illustrated mounting of the sealing member 13 for vertical movement renders it possible to highly reliably establish a clearance 17 of predetermined (optimum) width; such clearance is established at an end face and serves to ensure evacuation of air (at the location C) between the drum 4 and the adjacent surface of the bearing member 14.

The sender 1 is further provided with means for supplying into the flutes 6 a pressurized gaseous fluid (normally compressed air) which serves to expel the filter 7 at the location C lengthwise into the inlet of the conduit 2. To this end, the drum 4 comprises a flangelike control member 22 which is provided with elongated air passages 23, one for each of the flutes 6. Furthermore, the carrier 15 is provided with a transverse bore 24 which is arranged to communicate with a transverse bore 27 of the sealing member 13. The bore 27 is located between two sealing rings 26 installed between the sealing member 13 and the carrier 15.

The end portions of the pistons 19 are provided with or constitute heads 28 which extend through the carrier 15. The end faces of the heads 28 bear midway upon the sealing member 13, and these heads are located within the carrier 15 and are coupled thereto with a predetermined radial play.

The bearing member 14 is adjacent the location C and has a sealing surface 31 (this surface contacts the sealing member 13) as well as an axially parallel discharge opening 32 which registers with the inlet of the conduit 2 and serves to direct successive filters 7 into such inlet. In order to ensure that successive filters 7 will readily advance along and beyond the edges of the sealing surface 31, there is provided a ramp 34 which slopes upwardly toward the sealing surface 31 (as seen in the direction, indicated by the right-hand arrow 33, of propulsion of filters 7 into the conduit 2); such ramp is machined into the adjacent supporting and sealing surface of the sealing member 13.

Figure 2:
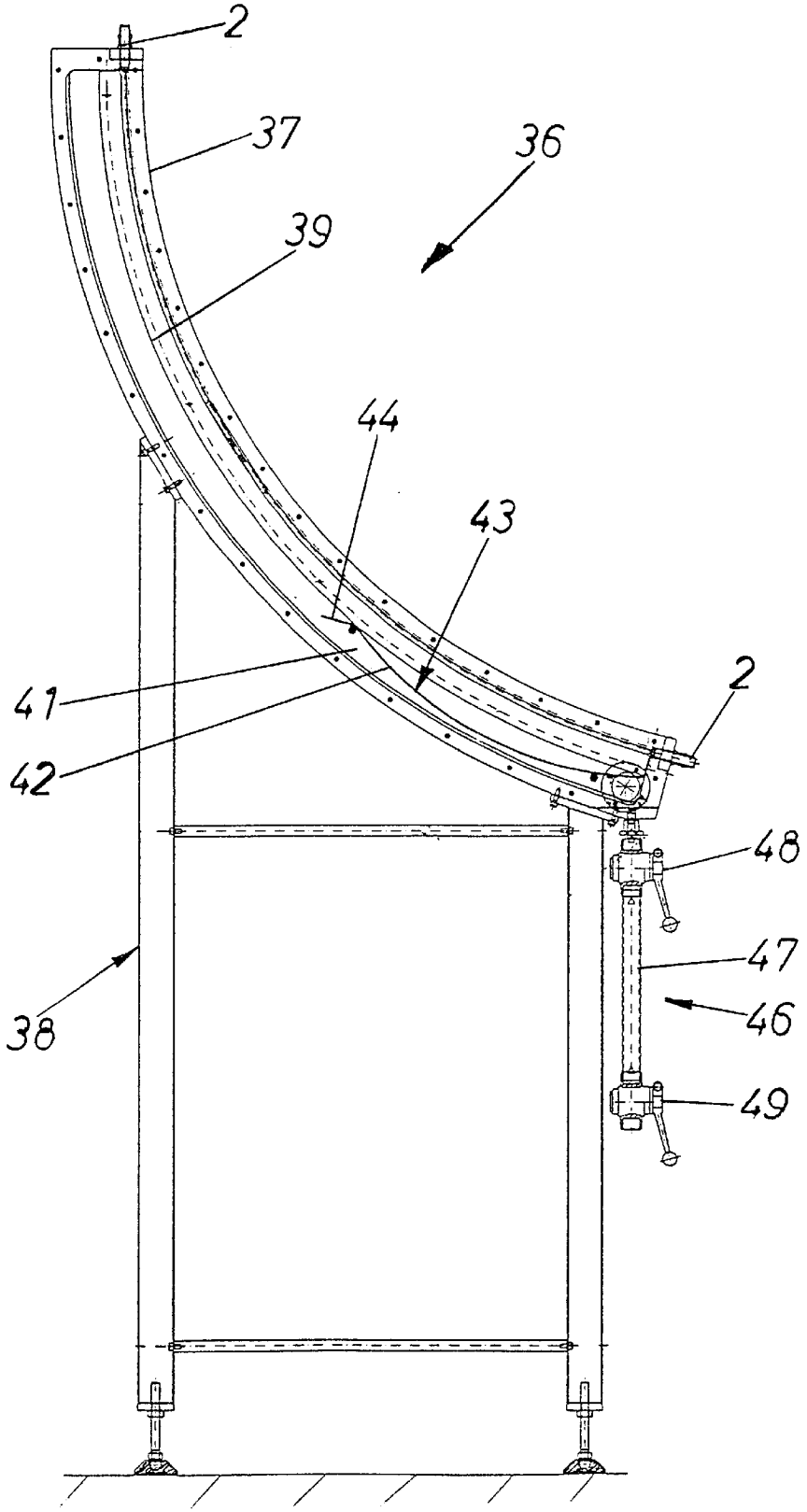
FIG. 2 is an enlarged elevational view of a mobile module including a conveyor section constructed and configurated in accordance with one presently preferred embodiment of the invention.
Figure 3:
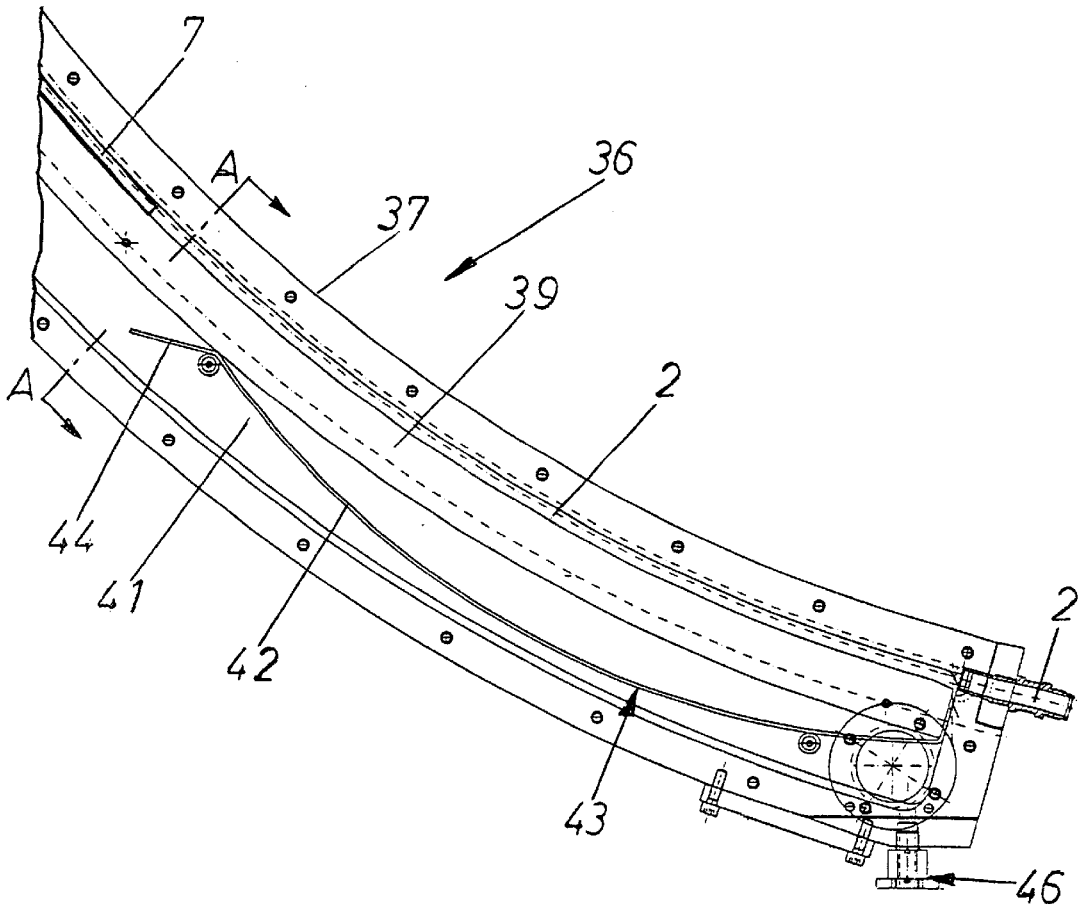
FIG. 3 is an enlarged view of a detail of the structure shown in FIG. 2.
Figure 4:
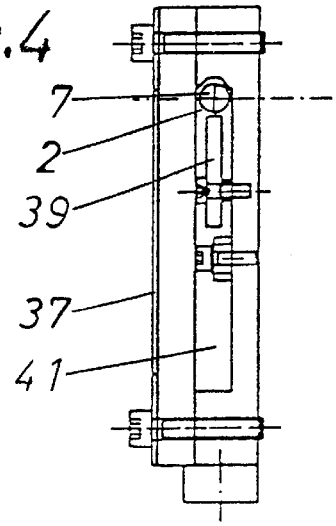
FIG. 4 is an enlarged schematic transverse sectional view substantially as seen in the direction of arrows from the line A—A in FIG. 3.

The section 36 of the conduit 2 is adjacent the latter's inlet, and its details are shown in FIGS. 2 and 3. This section extends from a lower level to an upper level along an arc of less than 180° (the illustrated arc matches or approximates 90°) and forms part of the mobile module 38. The latter further includes an arcuate part 37 which is or which can be designed and mounted to prevent the section 36 of the conduit 2 from changing its curvature so that such section can be repeatedly connected to and disconnected from the adjacent (straight or substantially straight) additional sections of the conduit 2 by any suitable fastener means. The section 36 can be integrated into the adjacent. Sections of the conduit 2 without departing from the spirit of the invention.

The convex underside of the section 36 is provided with an arcuate guide 39 which is located beneath the arcuate part 37 and defines a concave surface for lengthwise advancement of successive filters 7 upwardly and toward the receiving station 3. The guide 39 is flanked by arcuate openings (such as slots) serving to establish communication between the interior of the section 36 and an adjacent chamber 41 which gathers loose solid particles being expelled from the path for the filters 7. Such expulsion can take place in part under the action of pressurized gaseous fluid which is used to propel filters 7 toward the receiving station 3, and in part under the action of centrifugal force.

The lower portion of the convex underside of the section 36 is overlapped by a cover 43 which prevents pressurized fluid from flowing full blast into the chamber 41. At least the major portion (42) of the cover 43 is or can be made of a suitable resilient metallic sheet material, and the upper end portion 44 of the cover constitutes a suitably bent deflector or lug which serves to establish an optimum flow of gaseous fluid between the adjacent portions of the chamber 41 and the portion of the path defined by the section 36. The sheet metal part 42 of the cover 43 is preferably precurved (preshaped) in the manufacturing plant so that its underside (which faces the chamber 41) exhibits a convex shape.

The lower part of the section 36 is provided with an outlet 46 for intermittent or more or less continuous evacuation of intercepted and gathered solid particles from the chamber 41. FIG. 2 shows one embodiment of the outlet 46; the latter defines an upright compartment 47 with a first manually operable valve 48 at the upper end and a second manually operable valve 49 at the lower end.

Figure 5:
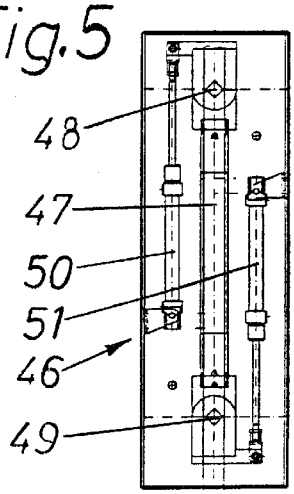
FIG. 5 is a similar sectional view of a modification of the structure shown in FIG. 4.

In the embodiment of FIG. 5, the valves 48, 49 are opened automatically (when necessary or at preselected intervals), e.g., as a function of time. To this end, the outlet 46 of FIG. 5 employs two fluid-operated cylinder-and-piston units 50, 51, one for each of the respective (automated) valves 48, 49.

The exact construction of the parts constituting the sender 1 forms no part of the present invention. As a rule, the operation of this sender is fully automated because it is expected to furnish several thousand filters per minute.

The mode of operation of the improved apparatus, and particularly of the parts shown in detail in FIGS. 2–4 and 5, is as follows:

In order to propel a filter 7 into the conduit 2 upstream of the section 36, the mobile sealing member 13 is lifted from its lower end position to the illustrated raised or operative position (for example, the sealing member can be moved to its lower end position, at fixed or arbitrary intervals, for the purpose of inspection and/or cleaning) When the sealing member 13 reaches the raised position of FIG. 1, the extent of movability of the heads 28 of the pistons 19 relative to the carrier 15 (i.e., the play of the aforediscussed loose connection between the carrier 15 and the heads 28) is such that the sealing ring(s) 26 is(are) stressed between the sealing member 13 and the carrier. Consequently, the crossheads 18 are in the process of taking up the compressive and bending stresses being applied to the bearing members 14 and 16. The corresponding system of the sender 1 shown in FIG. 1 is then under requisite stress. However, and since the diameter of the drum 4 is relatively small, there is established the aforediscussed predetermined clearance between the periphery of the drum and the sealing member 13; this allows for the friction-and hence wear-free operation of the sender 1.

When the prime mover for the drive shaft 11 is on, successive flutes 6 of the continuously rotating drum 4 accept discrete filters 7 from the source 12 at the location B and deliver discrete filters at the location C. The drum 4 is or can be driven at a constant speed, also during those stages of operation of the sender 1 when the filters 7 are in the process of being actually propelled from their flutes 6 axially and into the inlet of the conduit 2. Actual propulsion takes place when a flute 6 registers with the bore 32 of the bearing member 14; a blast of pressurized pneumatic fluid is then free to flow from the transverse bore 24 of the carrier 15, into the transverse bore 27 of the sealing member 13, thence into the air passage 23 then disposed at the location C, and ultimately into the aligned or registering flute 6. The thus admitted blast or jet of pressurized gaseous fluid expels the filter 7 from its flute 6 in the direction of the right-hand arrow 33 shown in FIG. 1 and into the inlet of the conduit 2. The ramp 34 is effective to further ensure entry of an axially advancing filter 7 from its flute 6 into the conduit 2.

Solid particles (such as charcoal granules) which are normally confined in the tubular envelope of a filter 7 (such granules can be distributed in the rod-like filler of the filter) are likely to escape from their envelopes (such envelopes can be made, for example, of cigarette paper) due to repated changes of direction (from sideways to lengthwise and/or vice versa), stoppages, acceleration and/or deceleration of a filter on its way into and through the source 12 and thence toward and into the inlet of the conduit 2. The thus obtained stray particles tend to clog the conduit 2 and/or to adhere to (and to thus cause coloration and/or other types of contamination of) the external surfaces of the filters 7. Therefore, there exists an urgent need for predictable, reliable, timely, simple and reproducible evacuation of loose solid particles from the path between the sender 1 and the receiving station 3. Such evacuation takes place in the region of the arcuate part 37 where the stray solid particles are acted upon by centrifugal force along an arc of 90° and are thus propelled into the chamber 41.

The cover 43 prevents solid particles from migrating out of the chamber 41 and back into the section 36 of the conduit 2. The deflector 44 establishes a fluid flow which actually draws loose solid particles from the interior of the section 36 into the chamber 41, namely a downwardly oriented fluid flow.

Solid particles which gather in the lower portion of the chamber 41 can be caused to descend into the compartment 47 in response to manual opening of the valve 48 shown in FIG. 2. Once the valve 48 is closed again, the person in charge opens the valve 49 to permit the accumulated solid particles to descend from the compartment 47 into a collecting receptacle (not shown) or onto or into a suitable conveyor, or to be caused to advance to another destination, e.g., back into the respective magazine of the machine which is utilized for the making of filters containing particles of charcoal and/or other material(s).

The outlet 46 should be put to use as frequently as is necessary to ensure that the pressure of conveying fluid in the conduit 2 cannot drop below a minimum acceptable (lower threshold) value.

The automatic arrangement 50, 51 of FIG. 5 which can be utilized in lieu of manually operated valves 48, 49 shown in FIG. 2 can be set up to open the valves 48, 49 of FIG. 5 sequentially at preselected intervals or in response to monitoring of the accumulations of solid particles in the compartment 47.

The mobile module 38 Of FIG. 2 can be replaced with a piece of arcuate pipe when the conduit extending from the sender 1 toward the receiving station 3 is set up to deliver a file of filters which are devoid of solid particles. Such module thus contributes to versatility of the improved apparatus.

An important advantage of the improved apparatus is that stray solid particles can be evacuated from an upstream section (36) of the conduit 2, i.e., in a region where the pressure of the pneumatic fluid is still very high. Such evacuation is possible because loose solid particles advancing toward and into the arcuate section 36 are still being acted upon by a pronounced centrifugal force.

Another advantage of the improved apparatus is that evacuation of loose solid particles from the section 36 of the conduit 2 into the collecting chamber 41 does not entail a pronounced drop of pressure of the fluid flow which is utilized to propel successive filters lengthwise from the sender 1 (or an equivalent sender) into the receiving station 3.

A further advantage of the improved apparatus is that the evacuation of collected solid particles (including dust) from the chamber 41 (via outlet 46) constitutes a simple and time-saving procedure which can be carried out while the conduit 2 continues to deliver filters to the station 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of transporting filter rods and, therefore, such adaptations should and are intended to be comprehended within the meaning and range of equivalence of the appended claims.

What is claimed is:

1. Apparatus for transporting tobacco smoke filtering rods, which carry solid particles, along an elongated path, comprising:

a sender;

a receiving station, said elongated path extending from the sender to the receiving station;

a pneumatic conveyor defining said elongated path for lengthwise advancement of successive filtering rods of a file of filtering rods by receiving a pressurized pneumatic fluid from said sender in a direction from the sender to the receiving station, said conveyor comprising a section located downstream of said sender as seen in said direction, extending along an arc of the path of less than 180° and arranged to advance successive filtering rods from a lower level to a higher level, said section having an at least substantially sealed arcuate upper side and an at least partially open arcuate underside;

a collecting device arranged adjacent to said section and having a chamber; and a cover overlying said underside of said section and arranged to permit expulsion of loose solid particles generated by said lenghtwise advancement of successive filtering rods from said path into said chamber of said collecting device and interfering with appreciable flow of pressurized gaseous fluid from said section into said chamber.

2. The apparatus of claim 1, wherein said section of said conveyor extends along an arc of substantially 90°.

3. The apparatus of claim 1, wherein the solid particles include charcoal.

4. The apparatus of claim 1, wherein said section of said conveyor is adjacent said sender.

5. The apparatus of claim 1, wherein said conveyor has an internal surface including a convex portion at said upper side and a concave portion at said underside.

6. The apparatus of claim 1, wherein said cover has a concavo-convex shape and includes a concave side confronting the underside of said section of said conveyor.

7. The apparatus of claim 1, wherein said receiving station includes means for temporarily storing at least one supply of filtering rods.

8. The apparatus of claim 1, wherein said sender includes means for pneumatically propelling filtering rods into said conveyor upstream of said section, as seen in said direction.

9. The apparatus of claim 1, wherein said sender includes means for advancing filtering rods along a substantially vertical and along a substantially horizontal portion of said path.

10. The apparatus of claim 1, wherein said cover includes a first end portion and a second end portion provided with a fluid deflector.

11. The apparatus of claim 10, wherein said second end portion of said cover is located at a level above said first end portion.

12. The apparatus of claim 1, wherein said section of said conveyor forms part of a prefabricated mobile module.

13. The apparatus of claim 12, wherein said section is an arcuate section and said conveyor further includes stationary additional sections, said arcuate section being detachable from and separably connectable with said additional sections.

14. The apparatus of claim 1, wherein at least a portion of said cover contains metallic sheet material.

15. The method of claim 14, wherein said sheet material is precurved.

16. The apparatus of claim 1, wherein said collecting device includes an upper end portion, a lower end portion upstream of said upper end portion, as seen in said direction, and at least one outlet for collected solid particles at said lower end portion.

17. The apparatus of claim 16, wherein said outlet defines at least one compartment having a particle receiving portion and a particle discharging portion, a first open-and-shut valve actuatable to connect said receiving portion of said compartment with said chamber, and a second open-and-shut valve arranged to permit and interrupt evacuation of solid particles from said discharging portion.

18. The apparatus of claim 16, wherein said outlet defines at least one compartment having a particle receiving portion and a particle discharging portion, said outlet including automatically operable valve means arranged to establish and to interrupt communication between said chamber and said at least one compartment.

19. The apparatus of claim 18, wherein said automatically operable valve means includes means for permitting and interrupting evacuation of solid particles from said at least one compartment.

20. The apparatus of claim 19, wherein said valve means is arranged to regulate the admission of solid particles into and the evacuation of solid particles from said at least one compartment as a function of time.

* * * * *